US007002326B1

(12) United States Patent
Smith et al.

(10) Patent No.: US 7,002,326 B1
(45) Date of Patent: Feb. 21, 2006

(54) METHOD OF MODULATING CURRENT REGULATION CONTROL LOOP'S CURRENT MAGNITUDE FROM A SECOND CONTROL SIGNAL

(75) Inventors: Gregory J. Smith, Tucson, AZ (US); Yinming Chen, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 140 days.

(21) Appl. No.: 10/657,575

(22) Filed: Sep. 8, 2003

(51) Int. Cl.
*G05F 1/40* (2006.01)

(52) U.S. Cl. ..... 323/282

(58) Field of Classification Search ..... 323/265, 323/268, 271, 277, 280, 282, 284, 285, 289
See application file for complete search history.

(56) References Cited

U.S. PATENT DOCUMENTS 4,065,804 A 12/1977 Rostad ..... 361/96
4,731,574 A * 3/1988 Melbert ..... 323/275
4,808,907 A * 2/1989 Main ..... 323/316
5,138,658 A * 8/1992 Carter et al. ..... 379/413
6,157,555 A 12/2000 Hemena et al. ..... 363/71
6,204,693 B1 * 3/2001 Forster et al. ..... 326/89
6,496,052 B1 * 12/2002 Chiu ..... 327/513
6,703,815 B1 * 3/2004 Biagi ..... 323/280

OTHER PUBLICATIONS

Jih-Sheng Lai et al., "Multilevel Converters—A New Breed of Power Converters," IEEE Transactions on Industry Applications, vol. 32, No. 3, pp. 509-517, May/Jun. 1996.
Gautam Sinha et al., "Rectifier Current Regulation in Four Level Drives," IEEE, pp. 320-326, 1997.

* cited by examiner

*Primary Examiner*—Matthew V. Nguyen
(74) *Attorney, Agent, or Firm*—Merchant & Gould P.C.; Timothy P. Sullivan

(57) ABSTRACT

The present invention provides current regulation. The circuit includes a current regulation loop that includes a second control signal that is used to adjust the magnitude of the regulated current. The second control signal provides a signal that regulates the amount of current being supplied to a load. According to one embodiment of the invention, at least one current source is used to modulate the magnitude of the regulated current when a predetermined condition occurs. The predetermined condition may relate to temperature, current, voltage, and the like.

19 Claims, 3 Drawing Sheets

METHOD OF MODULATING CURRENT REGULATION CONTROL LOOP'S CURRENT MAGNITUDE FROM A SECOND CONTROL SIGNAL

FIELD OF THE INVENTION

The present invention relates to electronic circuits and, more particularly, to electronic circuits for current regulation.

BACKGROUND

In the electronics industry, there is a need for regulating current. Many battery powered electronic devices include components for monitoring the current to and from a load, such as a battery pack. This is typically done by putting a sense resistor in the path between the battery pack and the load and also between the charging unit and the battery pack. A regulating circuit then measures the voltage across the sense resistors and limits the current to or from the battery pack accordingly. This limiting is typically performed by using a transistor in the current path from the battery pack to the load or charging unit and by causing the transistor's control terminal to be driven in response to the voltage across the sense resistor.

With battery and non-battery powered devices, often a main goal is to lose as little voltage as possible across the regulating circuitry when not limiting current. With typical current regulators, voltage is lost in two places: as current flows through the sense resistor and as current flows through the transistor. Consequently, when not limiting current in order to avoid wasting power or generating heat, it is desired that the resistance of the sense resistor and the resistance of the transistor be as low as possible for the area available for these components.

A transistor exhibits low resistance when its control terminal is held at a voltage appropriate to turn the transistor "full on." In current regulating circuitry, this is often accomplished through the use of an amplifier coupled to the sense resistor with the amplifier output driving the control terminal of the transistor. With the appropriate choice of sense resistor and amplifier characteristics, the current regulating circuitry can be constructed such that for currents less than a regulation current limit, the amplifier drives the control terminal of the transistor to a full on state. As current through the sense resistor increases above the regulation current limit, the amplifier drives the control terminal of the transistor to reduce the current to the regulation current limit. This has the effect of providing little resistance when current passing through the regulating circuitry is less than the regulation current limit and provides the appropriate amount of resistance through the transistor to limit the current to the regulation current when a load tries to draw an excess amount of current.

DETAILED DESCRIPTION

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means a direct electrical connection between the items connected, or an indirect connection through one or more passive or active intermediary devices. The term "circuit" means either a single component or a multiplicity of components, either active and/or passive, that are coupled to provide a desired function. The term "signal" means at least one current signal, voltage signal, electromagnetic wave signal, or data signal. The term "battery" includes single cell batteries and multiple cell batteries. The term "cell" includes single rechargeable cells and multiple rechargeable cells. The term "battery" and "cell" may be used interchangeably.

Briefly described the present invention is directed at regulating current using a second control signal. The circuit includes a current regulation loop that includes a second control signal that is used to adjust the magnitude of the regulated current. The second control signal provides a signal that regulates the amount of current being supplied to a load. According to one embodiment of the invention, at least one control signal is used to modulate the magnitude of the regulated current when a predetermined condition occurs. The predetermined condition may relate to temperature, current, voltage, and the like.

Figure 1:
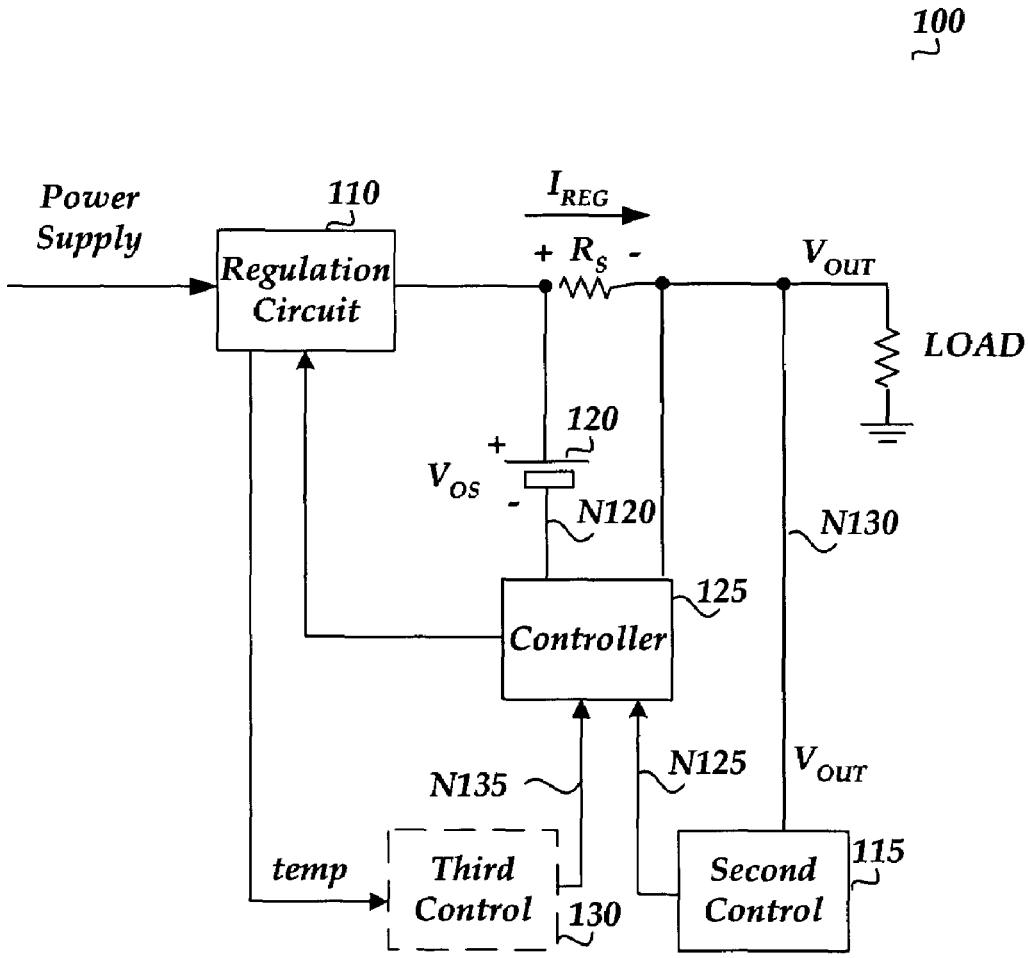
FIG. 1 is a simplified functional block diagram of a current regulation circuit using a second control signal.

FIG. 1 is a simplified functional block diagram of a current regulation circuit using a second control signal, in accordance with aspects of the invention. Current regulation circuit 100 includes a power supply, regulation circuit 110, resistor $R_S$, second control 115, third control 130, a small reference voltage $V_{OS}$ 120, controller 125, and a load. Resistor $R_S$ is used to sense the regulated current $I_{REG}$ and send a signal to second control 115. Second Control 115 is configured to generate a second control signal that is used to modulate the magnitude of $I_{REG}$. When activated based on a predetermined condition, second control 115 adjusts the signal at node N125 such that the output of controller 125 regulates current $I_{REG}$. As illustrated, optional third control 130 is configured to react to a temperature condition relating to regulation circuit 110. According to this embodiment, when a predetermined temperature is exceeded, third control 130 adjusts the signal at node N135 such that the output of controller 125 regulates current $I_{REG}$. While the figure illustrates two additional controls, more or less controls may be used. For example, one additional control control may be used or ten additional controls may be used.

Controller 125 responds to the signal at node N120 and node N125. In response to the signals, controller 125 outputs a signal to regulation circuit 110 regulating the current. According to one embodiment of the invention, as the magnitude of the signals at node N120 and node N125 become closer to one another, the more the current is regulated to the load. Regulation circuit 110 responds to the control signal sent from controller 125 by allowing an appropriate amount of current to reach the load.

In embodiments of the invention, controller 125 is as simple as an amplifier or as complicated as microprocessor. In other embodiments, control logic may be used to aid in determining the output of second control 115.

Figure 2:
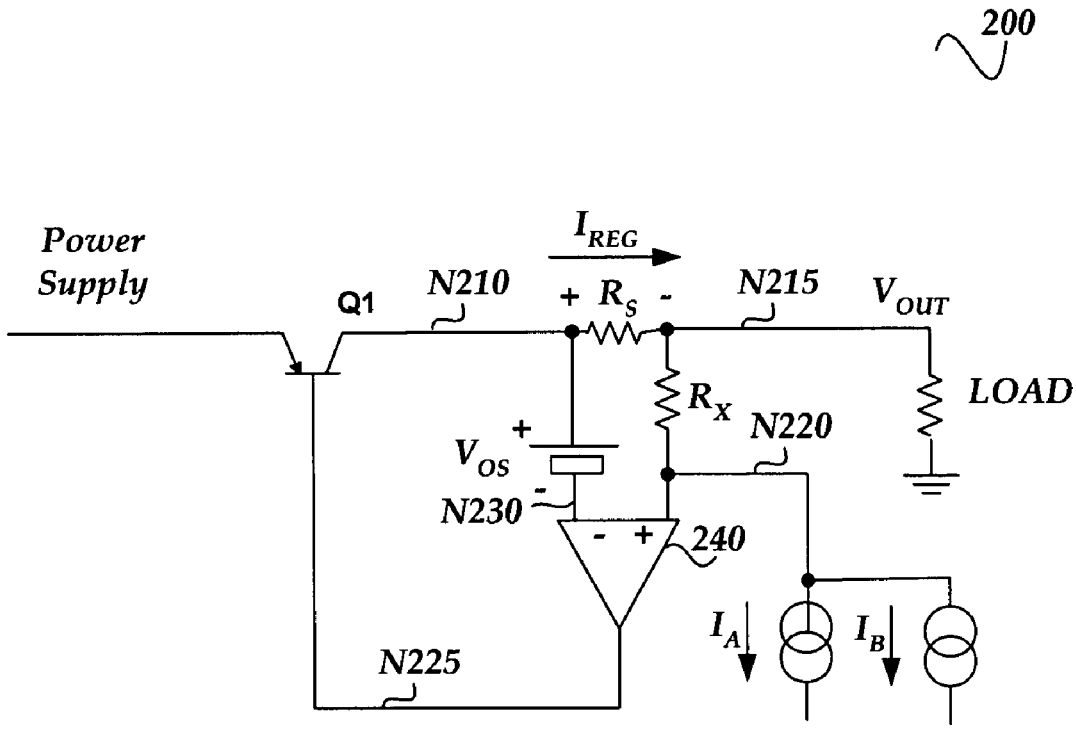
FIG. 2 illustrates a current regulation circuit.

In one embodiment of the invention, second control 115 comprises a resistor and a set of current sources that may be turned on or off depending on the desired current regulation (See FIG. 2).

FIG. 2 illustrates a current regulation circuit in accordance with aspects of the invention. As shown in the figure, current regulation circuit 200 includes a power supply, resistors $R_S$, $R_X$ and a LOAD, transistor Q1, $V_{OS}$, current sources $I_A$ and $I_B$, and amplifier circuit 240.

Transistor Q1 has an emitter coupled to the power supply, a base coupled to node N225, and a collector coupled to node N210. Resistor $R_S$ is coupled between node N210 and node N215. Amplifier circuit 240 has an input coupled to node N220, an input coupled to node N230, and an output coupled to node N225. The load (LOAD) is coupled between node N215 and ground.

The operation of current regulation circuit 200 will now be described. Power supply provides power to transistor Q1. Transistor Q1 is controlled by amplifier 240 to regulate the current supplied to the load. Amplifier 240 responds to the signals at nodes N230 and N240 by varying the signal at node N225 that is supplied to the base of transistor Q1. As long as the current passing through transistor Q1 is less than a current regulation limit, the amplifier drives the transistor control terminal such that the transistor is full on assuming $I_A$=0 and $I_B$=0 where the current to the load is limited to $V_{OS}/R_S$. When current regulation is needed, one or more of the control signals ($I_A$ and $I_B$) is activated thereby causing amplifier 240 to generate a signal to the base of transistor Q1 thereby regulating the current. More or less control signals may be utilized according to embodiments of the invention. Instead of cycling the current on and off as in some conventional current regulation circuits, the current may regulated by utilizing the current signal that provides the second control signal at node N220. The output of amplifier 240 drives the base of transistor Q1.

Specifically, amplifier 240 operates to keep its input terminals at the same voltage, if possible. To keep its terminals at the same voltage potential, enough current must flow through resistor $R_X$ to offset the voltage source $V_{OS}$ at the other input to the amplifier. When less current flows through resistor $R_X$, amplifier 240 tries to compensate by turning transistor Q1 more fully on.

$I_{REG}$ is set by the loop to be $V_{OS}/R_S$ ($V_{OS}$ could be created by inducing controlled systematic offset of the amplifier) When sinking current from the non-inverting input of the amplifier $I_{REG}$ may be expressed as:

$$I_{REG} = \frac{V_{OS} - R_X(I_A + I_B)}{R_S}$$

$I_A$ and $I_B$ can be derived from other control parameters in the system. For example, $V_{OUT}$, chip temperature, $V_{CE}$ of Q1 and the like. According to one embodiment, either $I_A$ or $I_B$ may be used to safely drive $I_{REG}$ to zero.

According to one embodiment, the current from at least one of the current singals is used to secondarily regulate the current supplied to the load. For example, current source $I_A$ may be used when one predetermined condition occurs and current source $I_B$ may be used when another condition occurs. The predetermined condition can depend upon many different scenarios. For example, current source $I_A$ may be used to regulate the current when a battery cell is being topped off such that as the battery voltage moves to its limit, $I_{REG}$ tapers to zero. In other embodiments of the invention, both current sources may generate currents to regulate the current supplied to the load. A temperature limit may also be the predetermined condition. Typically, the current sources would be integrated onto the same chip as the circuit needing current regulation. This integration would provide tight thermal coupling of the current sources to the circuit to be protected. The current sources could be constructed such that each had a different starting value and a different current slope. The current sources, however, are not constrained to be on the same chip as the circuit needing current limiting protection and could be any other circuitry capable of generating current.

Figure 3:
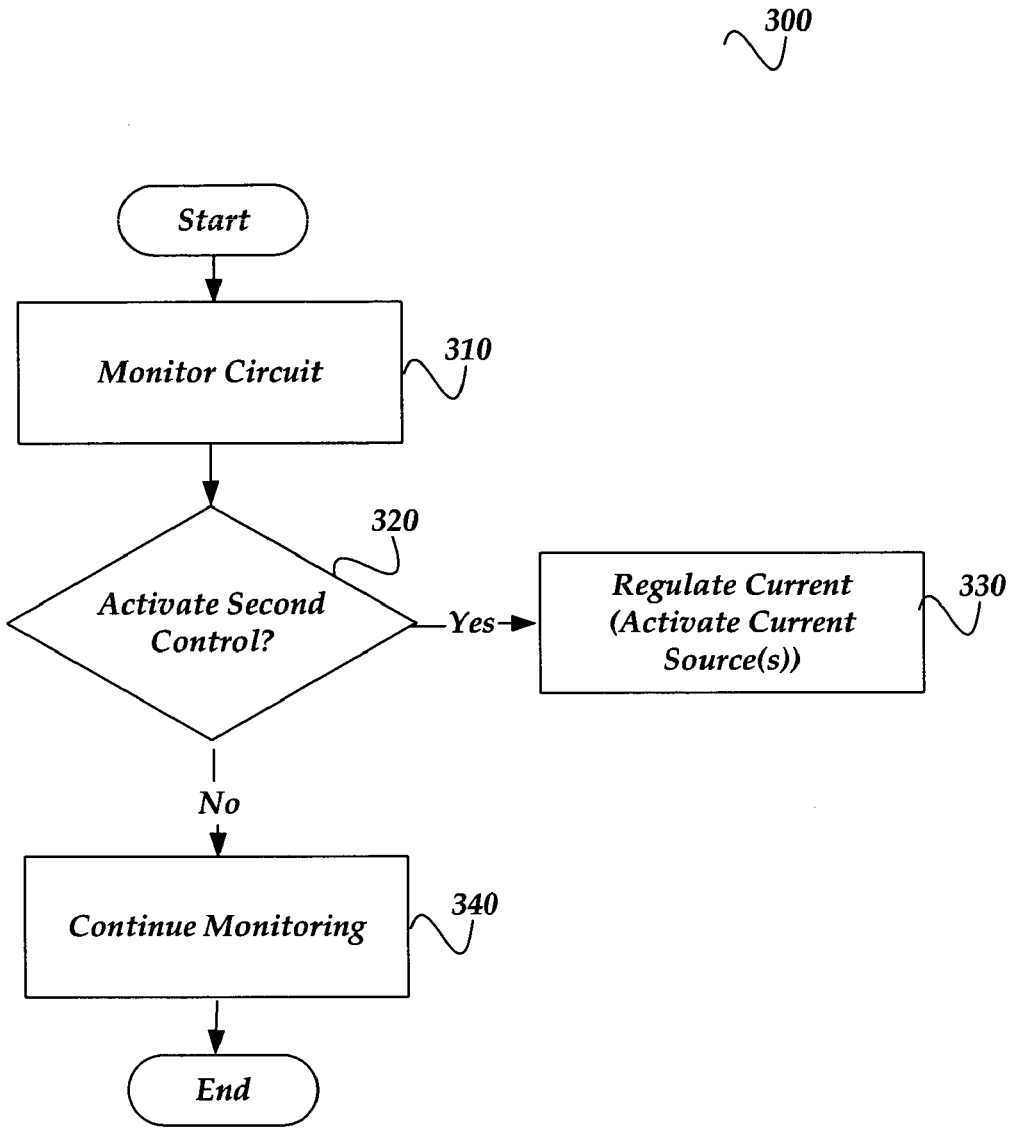
FIG. 3 illustrates a process for current regulation using a second control signal, in accordance with aspects of the invention.

FIG. 3 illustrates a process for current regulation using a second control signal, in accordance with aspects of the invention. After a start block, the process moves to block 310 where the circuit is monitored. According to one embodiment the circuit is monitored to determine if a predetermined temperature is exceeded. The circuit may also be monitored for many other conditions depending on the particular circuit. For example, in a battery charging circuit the battery may be monitored to determine when a different current should be used to charge the battery. Moving to decision block 320, a determination is made as to whether to activate the second control. The determination is based upon a predetermined condition occurring, based on conditions relating to temperature, current, voltage and the like. When the second control is activated the process transitions to block 330 where the current is regulated by activating one or more current sources, thereby reducing the current supplied to the load. When the second control is not activated the process flows to block 340 where the circuit is monitored. The process then flows to an end block where the process returns to processing other actions.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A circuit for current regulation, comprising:

a regulation circuit coupled to a power supply and to a first node and configured to generate a regulated current;

a first resistor coupled between the first node and a second node and configured to generate a signal relating to the regulated current that is supplied to a load;

a second controller coupled to the second node and configured to generate a second control signal used to adjust the regulated current; and a controller having a first input coupled to the first node and a second input coupled to the second control signal and an output coupled to the regulation circuit, wherein the controller is configured to generate a control signal used to generate the regulated current.

2. The circuit of claim 1, further comprising a reference voltage coupled to the first input and the regulation circuit.

3. The circuit of claim 1, wherein the regulation circuit is a transistor that is coupled to the control signal generated by the controller.

4. The circuit of claim 1, wherein the second control further comprises a second resistor and at least one current source.

5. The circuit of claim 1, wherein the controller further comprises an amplifier.

6. The circuit of claim 4, wherein the regulation circuit is a transistor that is coupled to an output of the amplifier.

7. The circuit of claim 6, further comprising a reference voltage coupled to an input of the amplifier.

8. The circuit of claim 4, wherein the at least one current source is activated in response to a predetermined condition.

9. The circuit of claim 8, wherein the predetermined condition is related to a temperature associated with the circuit.

10. The circuit of claim 8, wherein the amplifier is configured to generate the control signal such that the regulated current is driven to zero safely.

11. An apparatus for current regulation, comprising:

a transistor coupled to a power supply, a first node, and a second node;

a sense resistor coupled between the first node and a third node;

a second resistor coupled between the third node and a fourth node;

a first current source coupled to the fourth node; and an amplifier having a first input coupled to the first node and a second input coupled to a fourth node, and an output coupled to the second node.

12. The apparatus of claim 11, further comprising a voltage reference coupled to the first input of the amplifier.

13. The apparatus of claim 11, wherein the base of the transistor is coupled to the second node, the emitter is coupled to the power supply and the collector is coupled to the first node.

14. The apparatus of claim 11, further comprising a load coupled to the third node.

15. The apparatus of claim 11, further comprising at least one additional current source coupled to the fourth node.

16. A method for current regulation of a circuit, comprising:

utilizing a regulation circuit that is coupled to a power supply and to a first node and that is configured to generate a regulated current;

sensing the regulated current and generating a signal relating to the regulated current that is supplied to a load;

utilizing a second controller that is coupled to a second node and that is configured to active a second control signal that is used to adjust the regulated current; and utilizing a controller including a first input coupled to the first node and a second input coupled to the second control signal and an output coupled to the regulation circuit, wherein the controller is configured to generate a control signal that is used to adjust the regulated current.

17. The method of claim 16, wherein activating the second control signal further comprises utilizing a resistor and the at least one current source.

18. The method of claim 17, wherein adjusting the regulated current further comprises utilizing a single amplifier.

19. An apparatus for current regulation, comprising:

means for generating a regulated signal;

means for sensing the regulated signal between a first node and a second node;

means for generating a signal relating to the regulated signal that is supplied to a load;

means for utilizing a second controller that is coupled to the second node and that is configured to generate a second control signal that is used to adjust the regulated signal; and means for utilizing a controller including a first input coupled to the first node and a second input coupled to the second control signal and an output coupled to the means for generating a regulated sigal, wherein the controller is configured to generate a control signal that is used to adjust the regulated signal.

* * * * *

UNITED STATES PATENT AND TRADEMARK OFFICE

CERTIFICATE OF CORRECTION

PATENT NO. : 7,002,326 B1
APPLICATION NO. : 10/657575
DATED : February 21, 2006
INVENTOR(S) : Gregory J. Smith et al.

It is certified that error appears in the above-identified patent and that said Letters Patent is hereby corrected as shown below:

Column 6, Line 12: "configured to active" should read --configured to activate--

Column 6, Line 39: "a regulated sigal" should read --a regulated signal--

Signed and Sealed this

Nineteenth Day of September, 2006

JON W. DUDAS
*Director of the United States Patent and Trademark Office*